United States Patent [19]

Brauer et al.

[11] Patent Number: 4,779,842

[45] Date of Patent: Oct. 25, 1988

[54] HEIGHT-ADJUSTABLE RUBBER POT BEARING WITH AN ELASTOMER PLATE

[75] Inventors: Hans-Martin Brauer; Manfred Graeve, both of Aalen-Wasseralfingen, Fed. Rep. of Germany

[73] Assignee: Schwabische Huttenwerke GmbH, Wasseralfingen, Fed. Rep. of Germany

[21] Appl. No.: 41,193

[22] Filed: Apr. 22, 1987

[30] Foreign Application Priority Data

Apr. 22, 1986 [DE] Fed. Rep. of Germany ..... 3613545

[51] Int. Cl.[4] ..... B66F 3/24

[52] U.S. Cl. ..... 254/93 R; 92/207; 92/247; 92/249

[58] Field of Search ..... 254/93 R, 93 M; 52/744, 52/743; 92/240, 247, 249, 181 R, 204, 207; 248/649, 678, 188.2

[56] References Cited

U.S. PATENT DOCUMENTS

| | | | |
|---|---|---|---|
| 4,046,354 | 9/1977 | Stith | 254/93 R |
| 4,173,329 | 11/1979 | Stith | 254/93 R |
| 4,484,512 | 11/1984 | Dechavanne | 92/249 |
| 4,592,532 | 6/1986 | Stith | 254/93 R |
| 4,687,182 | 8/1987 | Andra et al. | 254/93 R |

*Primary Examiner*—Robert C. Watson

*Attorney, Agent, or Firm*—Collard, Roe & Galgano

[57] ABSTRACT

There is provided a height adjustable rubber pot bearing for supporting or lifting bridges. The pot bearing has an elastomer plate for transmitting and lifting or lowering loads wherein pressurized fluid is introduced between the bottom of the pot and the elastomer plate to displace the elastomer plate. A narrow slot is provided extending around the plate a small distance from and parallel with the inner side of the pot. The slot opens downwardly and has a depth of three-fourths of the plate thickness. A circular cylindrical insert is provided in the slot consisting of two parallel strips joined at their top edge with a space between them, the bottom edges of the strips being angled at right angles to form edge strips extending parallel with the bottom in opposing directions.

13 Claims, 5 Drawing Sheets

Fig. 2
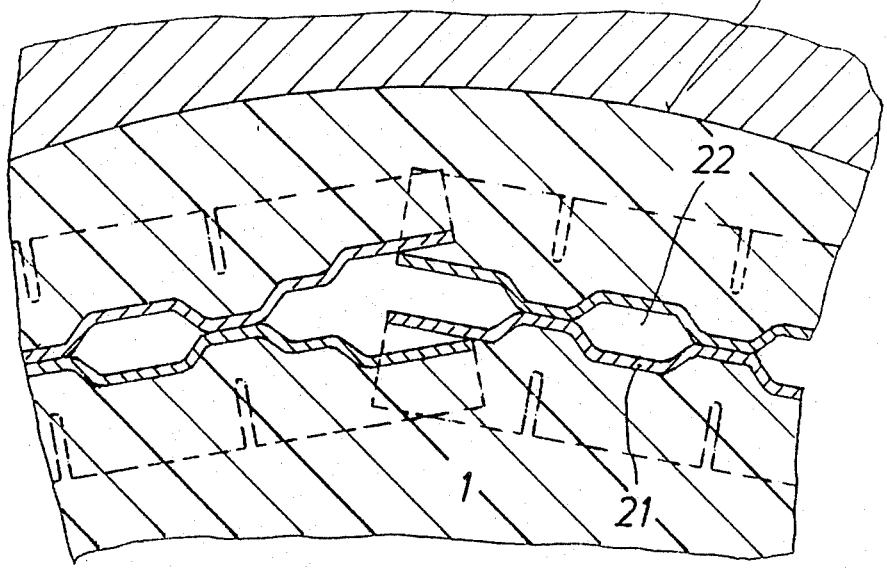
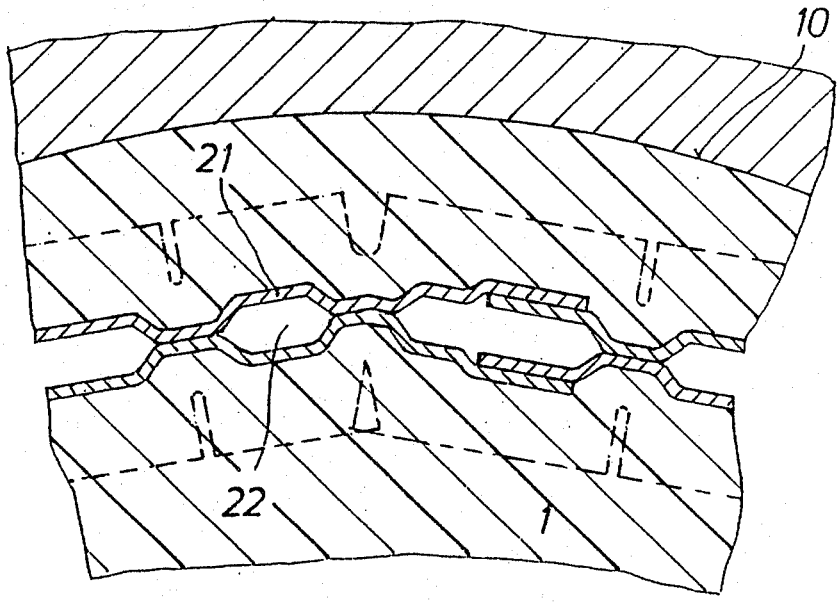
Fig. 2a 23
21
25

23
21
25
E
26
24

E
26
B
C
C
27
B

HEIGHT-ADJUSTABLE RUBBER POT BEARING WITH AN ELASTOMER PLATE

The present invention relates to a rubber pot bearing which is adjustable in height and is provided with an elastomer plate for transmitting and lifting or lowering heavy loads. More particularly, the present invention relates to such a pot bearing for use in bridge construction, in which an amount of pressurized fluid is introduced from the outside between the bottom of the pot and the elastomer plate for locally displacing the elastomer plate.

Rubber pot bearings of the type with which the present invention is concerned are known, for example from "Bautechnik" (Construction Engineering) 7/1984, page 227, illustration 13. With a bearing of this type, the problem is to seal the edge which extends around the elastomer plate against the inner wall of the bearing pot in order to prevent the injected pressure medium from being forced out. Based on the known rubber pot bearing, this problem is solved according to the present invention by providing the elastomer plate with a narrow slot a small distance from and parallel to the inner wall of the pot around the periphery of the elastomer plate. The slot opens downwardly and has a depth of three quarters of the thickness of the elastomer plate, with an insert having the shape of a circular cylinder inserted in the slot. The insert consists of two parallel strips which are joined with one another at their top edges to form a single piece with a small intermediate space between the two strips. The two strips are angled at right angles at their free edges to form edge strips which extend parallel with the bottom of the pot in opposing directions.

This embodiment creates a downwardly open annular hollow space enclosed by the two strips into which the pressurized fluid, which is admitted from the bottom, can enter and spread apart the insert. In this way, the contact pressure of the sealing lips on the inner wall of the pot is increased and the sealing effect is enhanced.

According to a special embodiment, the two strips can be provided with beads extending perpendicular to the angled edge strips, whereby such beads may be directed inwardly from both sides of the strips and may be in contact with each other, or such beads may be directed outwardly from the intermediate space between the strips.

According to another embodiment of the beads, the latter extend only up to a certain spacing from the joined top edges of the two strips, so that a top edge region remains free from beads, which reduces the stiffness of the top edge region, so that this part is capable of performing the function of a joint for spreading apart the two strips. This function of a joint is enhanced further if the part joining the two strips at their top edges has a tubular, circular cross section. According to a modification of this design, the part joining the two strips at their top edges may have a tubular, rectangular cross section.

According to the present invention, the insert may consist of either steel sheet or a plastic material. Furthermore, it is advantageous if the angled bottom edge strips extending at right angles relative to the strips have cuts in the form of slots with regular spacings between such cuts. Such cuts will prevent upsetting or excessive stress when the insert, which initially is straight, is deformed into a circular cylindrical structure. In addition, it may be useful if the circumferential surface of the elastomer plate is shaped before it is inserted or pressed into the pot in such a way that it is tapered upwardly in the shape of a cone.

According to another modification, the cylindrical insert may be comprised of a plurality of separate individual segments wherein the segments have a plug socket-like widening on one side, so that the individual segments can be installed in such a way that they overlap each other, straddling one another. In such an embodiment, the circumferential length or diameter of the insert assembled from individual segments can change slightly as the elastomer plate is pressed into the bearing pot. This means that the cylindrical insert is comprised of a polygon train of individual elements which, within themselves, are straight, whereby such individual elements are slightly bent around the vertical axis within the region of the widening if the elastomer plate has a small diameter.

Other objects and advantages of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 2 is a horizontal cross-sectional view taken along line A—A of FIG. 1;

Figures 3, 4, 7:
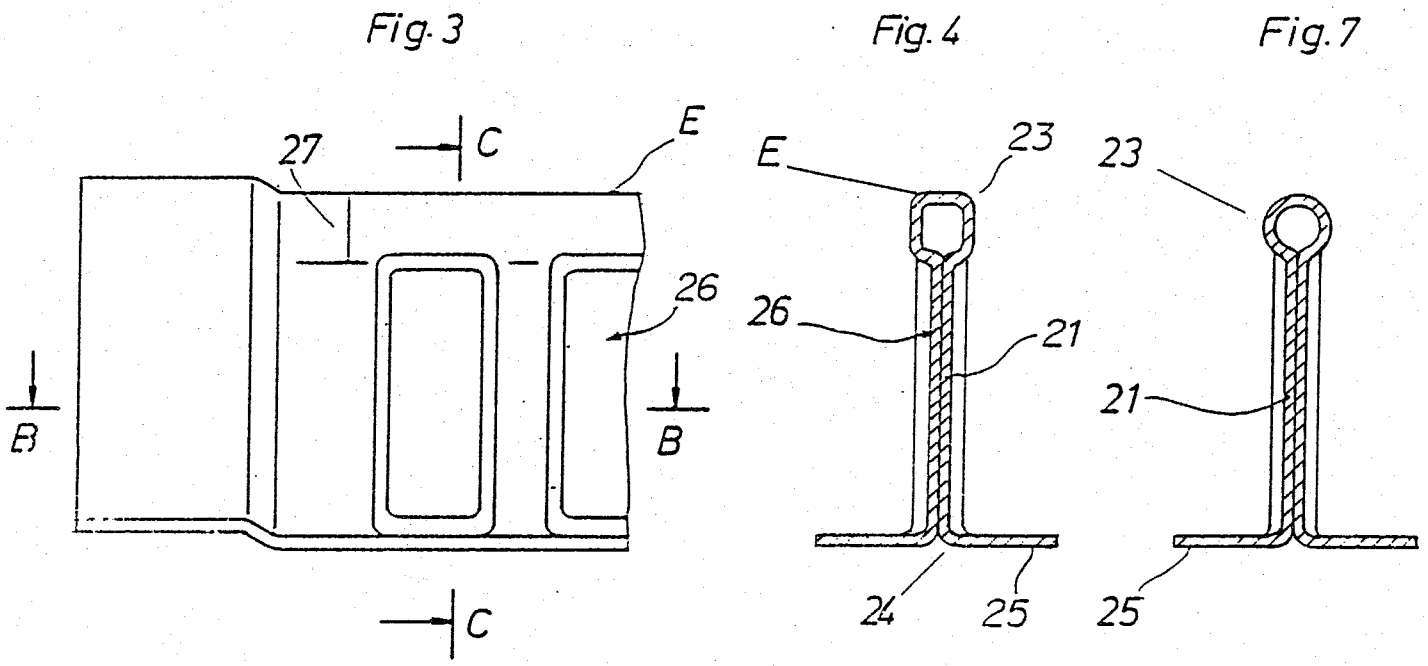
Figure 5:
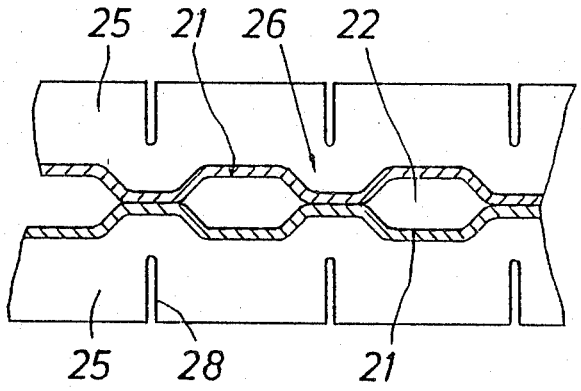
Figure 6:
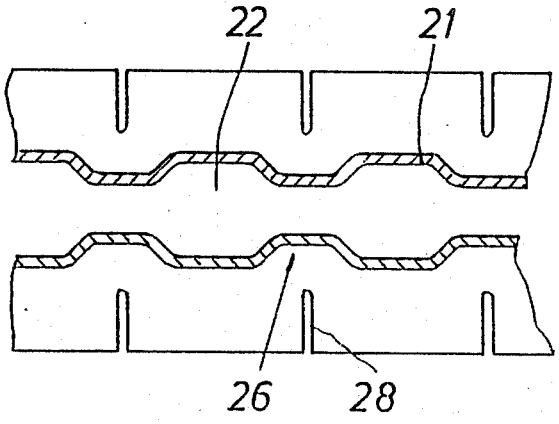
Figure 8:
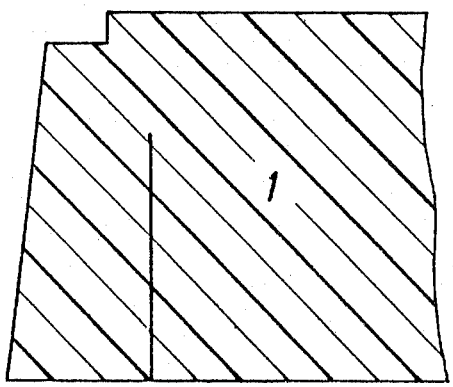
Figure 8A:
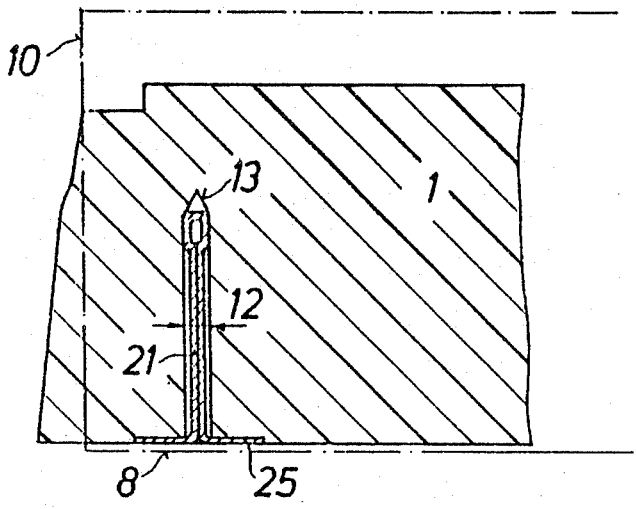

FIG. 2*a* is a horizontal cross-sectional view similar to FIG. 2, showing another embodiment of the present invention;

FIG. 3 is an elevational view of a portion of the insert;

FIG. 4 is a cross-sectional view taken along line C—C of FIG. 3;

FIG. 5 is a horizontal cross-sectional view taken along line B—B of FIG. 3;

FIG. 6 is an embodiment according to FIG. 5 with the insert in the expanded condition;

FIG. 7 is a cross-sectional view taken along line C—C of FIG. 3 showing a different embodiment;

FIG. 8 is a cross-sectional view of the elastomer plate before being pressed into the bearing; and FIG. 8*a* is a cross-sectional view of the elastomer plate with the installed insert before the plate is pressed into the bearing.

Figure 1:
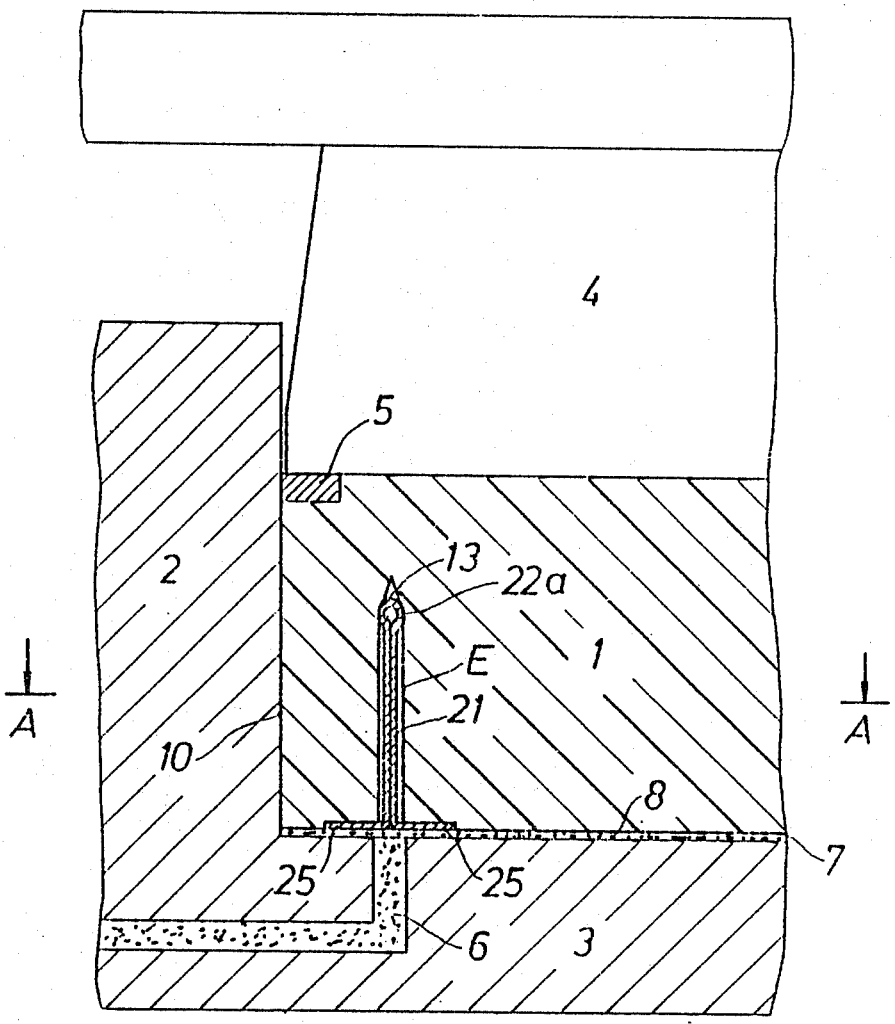
FIG. 1 is a vertical cross-sectional view through a rubber pot bearing with an elastomer plate according to the present invention.

Now turning to the drawings, there is shown in FIG. 1 an elastomer plate, designated 1, the side wall of the pot bearing, designated 2, and the bottom of the pot bearing, designated 3. The bearing lid 4 is positioned on elastomer plate 1. The gasket sealing the edge of the lid, designated 5, is installed in elastomer plate 1.

The pressurized fluid is introduced by way of feed conduit 6, filling the intermediate space between the bottom surface of elastomer plate 1 and surface 8 of bottom 3 of the pot, creating the intermediate space 7. The pressurized fluid, as clearly seen in FIGS. 2 and 2*a*, also penetrates hollow spaces 22 of the insert from the bottom, attempting to spread such insert apart, which increases the contact pressure of the sealing lip on inner wall 10 of side wall 2 of the pot.

The elevational view according to FIG. 3 of the insert shows that the beads 26 extend only about two thirds to three quarters the total height of the insert, so that a strip 27 remains free from beads. FIG. 4 shows that the inwardly directed beads 26 are in contact with each other without being connected with one another. The top region 27, wich is free from beads, essentially forms a joint permitting the side parts of the material strips acting as spreading legs to be spread apart. In the embodiment according to FIG. 7, this function of a joint is enhanced further in that this top region has a circular shape.

As clearly seen in FIGS. 5 and 6, hollow spaces 22 between beads 26, such spaces being filled by the pressure medium, are spread apart under the action of the pressure of the admitted pressure medium. FIGS. 5 and 6 show furthermore, that the angled edge strips at the lower edge can be provided with slots 28 in order to avoid upsetting and excessive stresses as the insert, which initially is flat, is deformed into the circular cylindrical shape.

FIG. 8 shows another advantageous embodiment of elastomer plate 1 wherein the outer surface is tapered upwardly. Before the elastomer plate is pressed into the pot, the contact pressure of the sealing lip is increased further by the upwardly tapered outer surface of the elastomer plate, such tapering being in the shape of a cone.

This is shown even more clearly in FIG. 8*a*, which shows elastomer plate 1 before it is installed in the bearing pot, with inner wall 10 of the pot being indicated by the dash-dotted line. Insert E, see FIG. 1, consisting of strips 21 is inserted in slot 13 and maintains the radial width 12 of the gap open. Reference numeral 8' denotes by the dash-dotted line the bottom of the pot. The edge strips 25 of insert E rest on the bottom of the pot and on bottom surface 8 of elastomer plate 1.

While several embodiments of the present invention have been shown and described, it will be obvious that many changes and modifications may be made thereunto without departing from the spirit and scope of the invention.

What is claimed is:

1. In a height-adjustable rubber pot bearing having an elastomer plate for transmitting and lifting or lowering heavy loads, for use particularly in bridge construction, in which pressurized fluid is introduced from the outside between the bottom of the pot and the elastomer plate, such fluid displacing the elastomer plate locally, wherein the improvement comprises a narrow slot in the elastomer plate extending around the plate a small distance from the inner side of the pot and parallel with the latter, said slot being open downwardly and having a depth equal to three quarters the thickness of the plate, and a circular cylindrical insert in said slot consisting of two strips extending parallel with each other with a small intermediate space therebetween, said two strips being joined with each other at their top edges to form a single piece, and said strips being angled at their bottom edges at right angles to form edge strips which extend parallel with the bottom of the pot in opposing directions.

2. The rubber pot bearing according to claim 1, wherein said two strips forming said insert have beads extending inwardly and directed perpendicular to the edge strips, said beads being in contact with one another.

3. The rubber pot bearing according to claim 1, wherein the two strips forming said insert have beads extending perpendicular to the edge strips, said beads being outwardly directed from the intermediate space between the parallel strips of the insert.

4. The rubber pot bearing according to claim 2, wherein said beads extend only up to a point spatially separated from the top edges of the two parallel strips, said edges being connected with one another.

5. The rubber pot bearing according to claim 4, wherein the part connecting the two strips forming said insert at their top edges has a tubular circular cross section.

6. The rubber pot bearing according to claim 4, wherein the part connecting the two strips forming said insert at their top edges has a rectangular cross section.

7. The rubber pot bearing according to claim 1, wherein said edge strips are provided with regularly spaced slots.

8. The rubber pot bearing according to claim 1, wherein said circular cylindrical insert is comprised of a plurality of separate individual segments.

9. The rubber pot bearing according to claim 8, wherein said individual segments are provided with a plug socket-like widening on one side, so that said segments can be inserted overlapping each other in a straddling arrangement.

10. The rubber pot bearing according to claim 8, wherein the individual segments forming said circular cylindrical insert are each substantially straight.

11. The rubber pot bearing according to claim 10, wherein with a small diameter of the elastomer plate, the individual elements are bent around the vertical axis within the zone of the widening.

12. The rubber pot bearing according to claim 1, wherein said insert is made of metal.

13. The rubber pot bearing according to claim 1, wherein said insert is made of plastic material.

* * * * *